United States Patent [19]

Bartsch et al.

[11] Patent Number: 4,665,842

[45] Date of Patent: May 19, 1987

[54] APPARATUS FOR PRODUCING IGNITABLE SOLIDS-GAS SUSPENSIONS

[75] Inventors: Adalbert Bartsch, Marxen; Georg Gospos; Lars Kersten, both of Hamburg; Arno W. Bartsch, Clausthal-Zellerfeld, all of Fed. Rep. of Germany

[73] Assignee: Norddeutsche Affinerie Aktiengesellschaft, Hamburg, Fed. Rep. of Germany

[21] Appl. No.: 784,841

[22] Filed: Oct. 4, 1985

[30] Foreign Application Priority Data

Oct. 5, 1984 [DE] Fed. Rep. of Germany ..... 3436624

[51] Int. Cl.[4] ..... F23C 5/12; F23M 9/00

[52] U.S. Cl. ..... 110/244; 110/265

[58] Field of Search ..... 110/243, 244, 256, 265, 110/263

[56] References Cited

U.S. PATENT DOCUMENTS

| | | | |
|---|---|---|---|
| 2,921,542 | 1/1960 | Kidwell et al. | 110/265 |
| 2,957,436 | 10/1960 | Lotz | 110/265 |
| 4,132,180 | 1/1979 | Fredrick | 110/244 |
| 4,507,075 | 3/1985 | Buss et al. | 110/265 |
| 4,515,093 | 5/1985 | Beardmore et al. | 110/265 |
| 4,574,710 | 3/1986 | Pickard | 110/244 |

FOREIGN PATENT DOCUMENTS

| | | |
|---|---|---|
| 891597 | 9/1953 | Fed. Rep. of Germany . |
| 1292631 | 4/1969 | Fed. Rep. of Germany . |
| 2253074 | 12/1975 | Fed. Rep. of Germany . |
| 3212100 | 10/1983 | Fed. Rep. of Germany . |

*Primary Examiner*—Henry C. Yuen

*Attorney, Agent, or Firm*—Karl F. Ross; Herbert Dubno

[57] ABSTRACT

An apparatus for producing ignitable solids-gas suspensions has a feeder for vertically feeding the solids-primary gas suspension, a secondary gas passage concentrically surrounding said feeder, and a stage for mixing both streams. In order to improve the igniting and melting of solids-gas suspensions in such apparatus, the feeder for the solids-primary gas suspension consists of a pressure relief vessel, which is provided with a tangentially extending supply line for supplying the solids-primary gas suspension, which supply line opens into said vessel in a substantially horizontal direction, and in that the pressure relief vessel is succeeded by two series-connected mixing stages which consist of venturi diffusers, the secondary gas passage concentrically surrounds the diffuser in the first mixing stage and the second mixing stage contains a flame-sustaining annular gas burner having fuel gas and oxygen nozzles arranged in alternation and surrounding the diffuser outlet, which is provided with a cooling chamber. The entire burner apparatus is mounted on the top rim of a vertical combustion shaft, which opens into a horizontal melting cyclone chamber.

9 Claims, 5 Drawing Figures

Fig.1
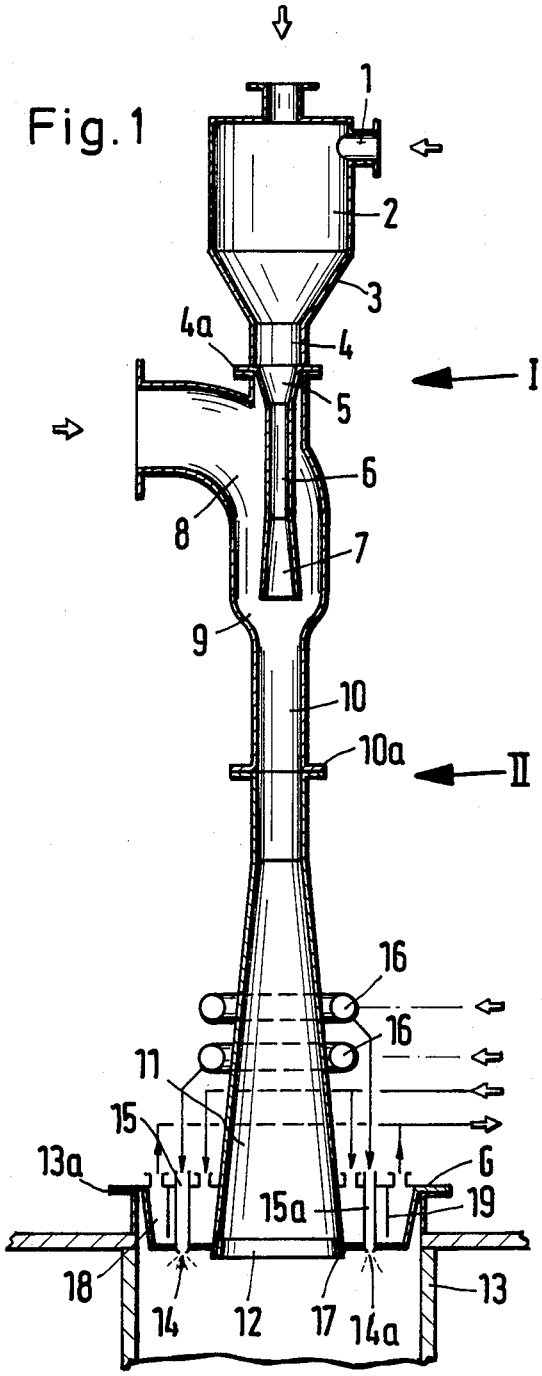
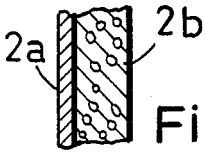
Fig.1A

APPARATUS FOR PRODUCING IGNITABLE SOLIDS-GAS SUSPENSIONS

FIELD OF THE INVENTION

Our present invention relates to an apparatus for producing an ignitable solids-gas suspension comprising a feeder for vertically feeding the solids-primary gas suspension, a secondary gas passage concentrically surrounding said feeder, and a stage for mixing both streams.

BACKGROUND OF THE INVENTION

In the operation of furnaces and in metallurgical processes it is often necessary to supply solids to be burned or chemically reacted to a combustion chamber or reactor in a suspension.

An apparatus of this type for producing such a suspension can be a burner and may comprise feeders which are uniformly arranged one in the other and are partly stationary and partly movable and initially produce a mixture of fuel and primary air and then mix that mixture with secondary air (German Pat. No. 891,597).

In order to effect, inter alia, a thorough mixing of pulverized coal and air, one embodiment of that apparatus comprises an insert, which is disposed in the primary air tube and imparts a swirl to the primary air before the pulverized coal is added so that the addition of the pulverized coal results in a swirling pulverized coal-air suspension owing to the swirling air. But because the subsequently added pulverized coal has a much greater mass than the air, the swirl of the latter is highly reduced or almost entirely eliminated upon such introduction so that the desired thorough mixing of all components is not effected.

German patent publication DE-AS No. 12 92 631 discloses apparatus for mixing solid particles in a gaseous entraining fluid. That apparatus comprises a swirling chamber, which has in cross-section the contour of a logarithmic spiral and has an inlet opening that is larger than its outlet opening. The supply line for the solids is coaxial to the pole and extends through the inlet opening and terminates approximately in the cross-sectional plane of the outlet opening. This apparatus in operation has the disadvantage that the solids enter the combustion or reaction chamber in a direction having a large vertical component and contact the wall defining said chamber before the reaction has been completed.

German patent publication DE-AS No. 22 53 074 discloses a process for the pyrometallurgical treatment of fine-grained solids at a temperature at which the solids are molten. In this process, a cyclone chamber is used and said solids are treated with high-oxygen gases and optional energy carriers. Sulfide ores and sulfide ore concentrates of non-ferrous metals are mixed with high-oxygen gases and optional energy carriers at a temperature below the reaction temperature to form a suspension, which at a velocity that is sufficient to prevent backfiring is charged into a vertical combustion passage and is reacted there. The resulting suspension contains mainly molten particles and is supplied to the cyclone chamber.

Laid-open German application DE-OS No. 32 12 100 discloses apparatus for a metallurgical treatment of non-ferrous metal ore concentrates, particularly sulfide ore concentrates. That apparatus comprises a generally vertically extending lance, which is provided with means for mixing gas and solids and with an accelerating nozzle, which is surrounded by an annular burner nozzle. The burner nozzle is provided with means for feeding the mixture of fuel and igniting material. In this apparatus a small nozzle is used to direct a heterogeneous mixture of solids, molten material and gas onto molten material contained in a hearth furnace. The residence times of the solids in the jet are extremely short so that the jet of particles which have not been completely reacted initiates a violent reaction in the bath and gives rise to a high turbulence in the bath. The apparatus has the disadvantage that the gas-solids suspension cannot be adequately mixed and that the solid particles remain in the gas jet only for a very short time so that the known apparatus can be operated only in reactors which contain molten baths.

OBJECTS OF THE INVENTION

It is the principal object of the invention to provide an improved suspension-generating apparatus which obviates the above-mentioned drawbacks.

It is also an object of the invention to provide an apparatus which serves to produce ignitable solids-gas suspensions, particularly such suspensions which contain sulfide ore concentrates and which apparatus is free of the disadvantages of the known apparatus, particularly the disadvantages mentioned hereinbefore, and is simple in structure and reliable in operation.

SUMMARY OF THE INVENTION

These objects are achieved in accordance with the invention by providing the feeder for the solids-primary gas suspension as a pressure relief vessel, which is equipped with a tangentially extending supply line for supplying the solids-primary gas suspension, which supply line opens into said vessel in a substantially horizontal direction.

The pressure relief vessel is succeeded by two series-connected mixing stages which each consist of a Venturi diffuser, the secondary gas passage concentrically surrounding the diffuser in the first mixing stage.

The second mixing stage contains a flame-sustaining annular gas burner having fuel gas and oxygen nozzles arranged in alternation and surrounding the diffuser outlet, which is provided with a cooling chamber.

The primary and secondary gases required to produce the ignitable solids-gas suspension obviously contain oxygen. Air or oxygen-enriched air or commercially pure oxygen may be used for that purpose.

By means of the apparatus in accordance with the invention an ignitable gas-solids suspension supplied to the apparatus is entirely homogenized in the mixing stages and a reliable ignition and a virtually complete melting of the solid particles within the burner jet are effected at the outlet of the second mixing stage. The flame-sustaining gas burner is important for the spontaneous ignition of the fuel jet, for sustaining the flame and for a transfer of heat energy in the backflow region. That burner design results in a substantial flattening of the ignition profile cone.

In the apparatus in accordance with the invention a solids-primary gas suspension containing, for example a complex sulfide ore concentrate, is supplied through the inlet pipe into the cyclone-like pressure relief vessel.

The pressure relief vessel suitably comprises on its inside an internal ceramic wear-resisting layer, e.g. of concrete.

Because solids having a particle size below 40 μm and above 40 μm to 110 μm are pneumatically conveyed into the pressure relief vessel and because a swirl is generated in that vessel, the solids leaving the cyclone-like pressure relief vessel through the connecting pipe have a certain swirl as they enter the mixing stage.

For instance, a gas-solids suspension may enter the Venturi diffusor of the first mixing stage (I) at a velocity of flow of about 15 m/sec.

The mixing stage I consists of a Venturi diffuser, specifically a diffuser having a convergent entrance passage, a cylindrical mixing passage, and an outwardly flaring diffuser passage.

By means of a flange joint the Venturi diffuser of the mixing stage (I) is detachably connected to the cyclone-like pressure relief vessel.

A gas stream laden with solids in a proportion of, for example, 17 to 27 kg solids per standard cubic meter ($sm^3$ $m^3STP$) of gas is accelerated and is agitated to a high turbulence in the cylindrical mixing passage. The mixing passage of mixing stage (I) has a length which is, for example, 4 to 6 times the diameter of said passage, and the turbulence reached in said passage corresponds to a Reynold's number of 1.5 to $1.7\times10^5$.

The diverging portion 7 of the diffuser passage has an angle of taper of about 3 to 7 degrees.

The parts (5, 6, 7) of the mixing stage (I) serve to homogenize a solids-gas suspension which has been supplied with a swirl and to reduce that swirl. If the residence time and the remaining relative velocities between the gas and solids and between the finer and coarser solid particles are properly selected, the high turbulence will result in a movement of the fluid particles in a direction which is transverse to the axis of the stream so that a more effective homogenization of the mixed stream will be achieved. Because the mixing passage has a length which is, say, 4 to 5 times its diameter, vortices or separated jet portions forming in the convergent passage will be eliminated before the jet enters the diffuser. Owing to the small angle of taper of the diffuser, irregularities of the flow in the jet and of the density therein can be avoided.

The secondary gas passage can be formed by an elbow having a vertical arm which concentrically surrounds the diffuser. Adjacent to the outlet of the diffuser, the secondary gas passage can merge into a cylindrical passage, which is smaller in diameter and virtually equal in diameter to the outlet of the diffuser. The secondary gas passage serves to feed a reactant gas stream, such as a stream of oxygen-enriched air.

The transition from the cross-section of the secondary gas passage to the mixing passage does not involve a step in cross-section and is preferably curved (convex or concave) or cone-shaped. That design ensures that a deposition of solids which would give rise to unstable conditions with irregular loadings and/or irregular stream densities will be avoided.

The diameter of the mixing passage is so selected that a considerable turbulence corresponding to a Reynold's number of 3 to $7\times10^5$ will be achieved. Certain measures may be adopted to prevent a separation of flow and a formation of vortices at the outlet of the burner. Such measures include, for example, the provision of a mixing passage having a length of, say, 5 to 8 times its diameter and a smooth transition to the succeeding diffuser with a small angle of taper of, say, 2.5°.

Vortices would result in an irregular ignition of the jet, e.g., in a suppression or restriction of the backfiring into the diffuser. This would give rise to considerable disturbances, such as incrustation.

In the apparatus in accordance with the invention the transition between different cross sections, the taper and the outlet diameter of the diffuser passage are so matched to each other th the two streams consisting of the secondary gas stream and the stream formed by the solids-gas suspension will be perfectly mixed and solids in a state of homogeneous distribution will enter the mixing stage.

In the apparatus in accordance with the invention the secondary gas stream suitably flows at a velocity which is higher than that of the stream formed by the solids-gas suspension and a relative velocity of 5 to 15 m/sec. is maintained between said two streams.

In the apparatus in accordance with the invention a second Venturi diffuser is vertically spaced from and succeeds the first and is connected to the latter by a flange joint. The second Venturi diffuser constitutes the mixing stage (II). The angle of taper of the diffuser amounts to 1.5 to 4, preferably to 2 to 3 degrees. An angle of taper of 2.5° has been found to be particularly advantageous. A flame-sustaining annular gas burner is mounted at the end of the Venturi diffuser or in the outlet portion of the diffuser and surrounds said outlet.

The annular burner comprises separate distributing tubes for fuel gas and oxygen, respectively. The separate nozzles for fuel gas and oxygen are arranged in alternation with a spacing of about 40 mm to form a coaxial circular series. The distance of to the separation-inducing edge is about 35 to 40 mm.

The nozzle tips are detachably connected to the feeders by means of screwthreads. The feeders extend through the cooling chamber and are welded into the top and bottom ends of the burner by joints which are sealed against water under pressure.

An inner guide ring serves for a uniform distribution of the cooling water. The annular cooling chamber has usually a height of 10 to 30 cm, preferably of 15 to 20 cm. The flame-sustaining gas burner is made of an alloy steel which contains chromium and nickel, such as the alloy steel designated by Material No. 4571. The use of such materials and the provision of a cooling chamber for the diffuser ensure a protection of the material against a formation of scale. That protection is important for a prevention of accidents.

Adjacent to the plane of the burner outlet a separation-inducing edge which is similar to a knife edge is provided at the outlet of the Venturi diffuser and protrudes from said plane. The separation-inducing projecting edge has a height between 10 and 20 mm and serves to exactly define the location at which the ignition begins outside the outlet of the burner in close proximity thereto. As a result, the backflowing combuston gases, which are at a high temperature, and the mixed jet formed by the solids and gas, impinge on each other at an acute angle so that the annular base surface of the flame-sustaining gas burner provides virtually no surface for a deposition of solids. Besides, the separation-inducing edge prevents irregularities in the ignition, which could arise if vortices were contained in the fluid jet before it leaves the Venturi diffuser. Such irregularities would result in a stressing of the inside surface of the diffuser by a premature reaction, overheating and incrustation.

Nevertheless, an additional protection of the components of the flame-sustaining gas burner is provided in those regions which are subjected to particularly high temperatures, such as the surfaces defining the outlet of the burner and the lower end and the peripheral surfaces of the cooling chamber. Suitable protecting layers may consist, for example, of cobalt or zirconium, which at the operating temperatures of the apparatus in accordance with the invention do not tend to scale or to form alloys with molten components of the suspended solids, such as copper or lead.

Just as the other parts of the apparatus, the separation-inducing edge is suitably made entirely or in part of chromium-nickel steel. The knife may be further improved by forming the outer region of the separation edge, i.e., its knife edge, with a layer or coating of a fused or sintered material which contains, for example, cobalt or zirconium. The selection of that material will depend on the dissolving power of the solid and liquid components of the reactant jet.

In the apparatus described hereinbefore the materials will resist the operating conditions in the apparatus in accordance with the invention, i.e., elevated temperatures and exit velocities of the mixed jet of about 19 to 28 m/sec. without damage.

In accordance with a further feature of the invention, the flame-sustaining gas burner or the entire apparatus is mounted by means of a flange joint with a steplike transition on the top edge of a known vertical combustion shaft and the bottom rim of the combustion shaft is rigidly mounted on a horizontal melting cyclone chamber.

The length of the combustion shaft depends on the size of the so-called concentrate burner and will be smaller the smaller the distance x is from the point of maximum flame temperature from the outlet of the burner. That distance x is determined by the relation $$x=f[W_A/(d_A\times k)]$$

in which f=function $W_A$=exit velocity at burner outlet $d_A$=diameter of burner outlet k=burner coefficient (empirically derived).

For instance, when certain copper ore concentrates are processed at a throughput rate of about 8000 kg/h, the length of the combustion shaft will be about 180 cm.

In larger production units (larger concentrate burners), $d_A$ may be larger so that the flame length x and the length of the combustion shaft may be smaller. The cyclone chamber has usually a length of 1 m and a diameter of about 95 cm.

In accordance with a further preferred feature of the invention, a two-chamber premix burner used as a pilot burner is provided in the region in which the combustion shaft opens into the horizontal combustion chamber. That pilot burner is mounted in the bottom of the horizontal cyclone chamber, preferably in the shell of the cyclone, and the axis of the jet produced by that burner is directed onto the lower portion of the inside surface of the cyclone chamber. A spark plug for igniting that pilot burner is provided in a hood consisting of a monolithic refractory. The stable flame jet emerging from the hood is guided into a cylindrical combustion passage, which has an enlarged portion defined by a step.

In a particularly desirable embodiment of the invention, the two-chamber premix burner is provided in the igniting passage with a high-pressure solid-jet nozzle, which can be fed with a liquid-reducing agent, such as oil, which is injected through the gas flame jet of the premix burner into the cyclone chamber. The reducing agent effects in known manner a reduction of any slag which is formed. That slag is suitably reduced before the molten material flows from the cyclone chamber into a receiving vessel, which usually succeeds that chamber. If such nozzle is provided, it is suitably cooled by the gas-air stream which has not yet been ignited and an adverse effect on the nozzle by cracking processes is avoided.

Means may be provided for optically monitoring the flame through a central pipe. Besides, the pilot burner may be controlled in dependence on all other burners so that an absolutely reliable melting operation will be ensured.

The apparatus in accordance with the invention is particularly suitable for the pyrometallurgical treatment of sulfide ores or sulfide ore concentrates of non-ferrous metals. The apparatus in accordance with the invention ensures a fast and complete ignition of the mixed jet leaving the mixing chambers by a short, hot flame at a small distance from the outlet of the burner. As a result, solid particles are virtually completely melted in a jet which is discharged at a velocity in the known range below 30 m/sec.

The molten film running down on the inside surface of the cyclone is processed further in the known manner in that the molten material from the film is collected at the outlet of the cyclone chamber and is drained as a jet through an outlet slot to enter a secondary chamber, from which it is supplied to a forehearth through a vertical chute. The components of the molten material which differ in specific gravity, such as matte and slag, are separated in and separately withdrawn from the forehearth.

The apparatus in accordance with the invention can be used to treat numerous solid materials, particularly suflide ores or sulfide ore concentrates of non-ferrous metals and sulfide ores or sulfide ore concentrates of iron. It is also highly suitable for the treating oxide iron ores or oxide iron ore concentrates, which may have been prereduced, and to treat intermediate metallurgical products.

BRIEF DESCRIPTION OF THE DRAWING

The above and other objects, features and advantages of our present invention will become more readily apparent from the following description, reference being made to the accompanying highly diagrammatic drawing in which:

FIG. 1 is a diagrammatic sectional view showing apparatus in accordance with the invention;

FIG. 1A is a section of the wall of a part of this apparatus;

SPECIFIC DESCRIPTION

Figure 2:
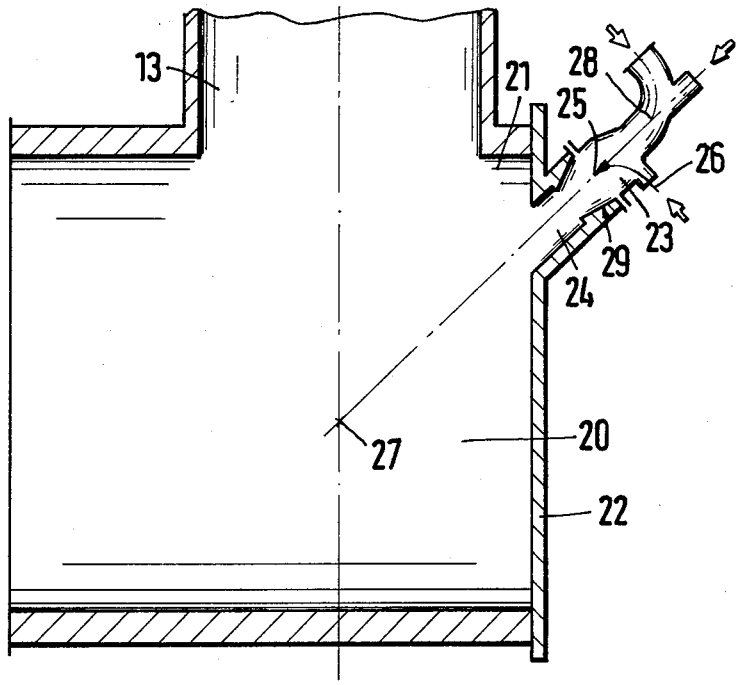
FIG. 2 is a sectional view showing the combustion shaft and the cyclone chamber which constitute the lower part of the apparatus in accordance with the invention.

In the apparatus shown in FIG. 1, a feedstock consisting of a solids-gas suspension is supplied through an inlet pipe 1 to a pressure relief vessel 2, which has a conical portion 3 and a cylindrical portion or connecting pipe 4, which is connected by a flange joint 4*a* to the mixing stage I.

The latter consists of a venturi diffuser having a convergent passage 5, a cylindrical mixing passage 6 and a diffuser passage 7. The venturi diffuser is concentrically surrounded by the secondary gas passage 8, which is defined by an elbow, which is connected by a transitional portion 9 to a cylindrical mixing passage portion 10, which is smaller in diameter. The mixing stage I is connected by a flange joint 10*a* to the mixing stage II. The latter comprises a venturi diffuser 11, which at its outlet portion is provided with a flame-sustaining annular gas burner G. The latter has separate distributing pipes 16 for fuel gas and oxygen, respectively. The distributing pipes are respectively connected to separate supply pipes 15 and 15*a* for fuel gas and oxygen. The supply pipes 15, 15*a* detachably connected at their outlet ends by screw threads to nozzles 14, 14*a*. A separation-inducing annular edge 17 is provided. The cooling chamber 18 is provided with an inner guide ring 19 for a uniform distribution of the pressurized cooling water. The burner is mounted by a flange joint 13*a* on the combustion shaft 13. The outlet 12 of the burner communicates with the combustion shaft 13 without a transition.

The chamber 2 has a wall *2a* provided with a concrete lining *2b*.

FIG. 2 shows the transition between the burner shaft 13 and the horizontal cyclone chamber 20. A two-chamber premix burner 23 having an igniting passage 24 is mounted on the cylindrical bottom 22 of the cyclone chamber 21 adjacent to the outlet of the combustion shaft 13. That burner ejects a jet in a direction 27 onto the lower portion of the inside surface of the cyclone chamber. A spark plug 29 ignites the mixed gas stream 28 and the liquid fuel jet 26 discharged by the solid-jet nozzle 25.

EXAMPLE

Copper ore concentrate at a rate of 7000 kg/h supplied from preceding bin, drying, proportioning and mixing means are entrained by primary air as a primary gas supplied at a rate of 390 sm $^3$/k and the resulting suspension is supplied through a feeding pipeline to the inlet pipe 1 of the pressure relief vessel 2.

The concentrate has the following composition by weight:

Cu: 21–23%
Fe: 22–25%
S: 30–33%
Zn: 7–10%
Pb: 6–9%
$SiO_2$: 1% and has a particle size between 0.5 and 100 μm with a fraction of 53% in the range from 15 to 100 μm and a residual moisture content of 0.1 to 0.3%.

A slag-forming material consisting of $SiO_2$ in the form of sand is supplied at a rate of 1300 kg/h to the concentrate-air stream before the pipe 1 so that the FeO which will be formed will be combined in a slag. Sand having a residual moisture content of 0.1% and a particle size up to 0.7 mm is used for that purpose.

A fluid stream consisting of concentrate at a rate of 7000 kg/h, sand at a rate of 1300 kg/h and entraining air at a rate of 350 sm$^3$/h is supplied through the pipe 1 to the pressure relief vessel 2 and flows from the latter through the constriction 5 into the mixing passage 6 of the mixing stage II, in which the jet is accelerated to a velocity of 39 m/sec. In the mixing passage 6 having the selected diameter a turbulence corresponding to a Reynold's number of $0.67\times10^5$ is reached. The L:D (length to diameter) ratio of the mixing passage 6 is 5. The jet then passes through the stepless transition having a radius of 100 mm from the mixing passage 6 into the diffuser 7, which has an angle of taper of 5 degrees and a largest diameter of 95 mm.

The homogenized fluid jet is discharged from the venturi diffuser 7 at a velocity of, e.g. 15.9 m/sec and together with a mixed secondary stream consisting of 600 sm$^3$/h air and 1800 sm$^3$/h oxygen from the secondary gas passage 8 enters the receiving portion of the mixing passage 10 of the venturi mixing stage II.

The jet discharging by the diffuser 7 and the secondary stream flowing in the surrounding secondary gas passage 8 have a velocity of 9.3 m/sec relative to each other.

These two streams are mixed in the mixing passage 10 at an average velocity of flow of 70.5 meters per second in the jet, a ratio of L:D (length to diameter) of 5.4 and an initial turbulence corresponding to a Reynold's number of $6\times10^5$. The mixed streams are then transferred into the diffuser 11 of the mixing stage II. In order to avoid a separation of flow, the diffuser 11 has an angle of taper of 2.5 degrees. The fluid jet which has not yet been ignited is discharged from the outlet 12 of the burner at an average velocity of 18.5 meters and without vortices.

Owing to the sudden change in diameter from 230 mm at the outlet 12 of the burner to 500 mm in the combustion shaft 13 and owing to the axial alignment of the homogenized jet which is being discharged, hot combustion products and gases will flow back on the outside and in operation with the flame-sustaining device 14 and 14*a* will result in a complete ignition of the fluid jet a the separation-inducing edge 17.

Fuel for sustaining the flame is supplied as natural gas at a rate of about 30 sm$^3$/h if the concentrate throughput amounts to 6000 to 10,000 kg/h. At the outlet 12 of the burner, the homogenized fluid jet discharged across the separation-inducing edge 17 is free of vortices and there will be no separation of flow and formation of vortices adjacent to the boundary layer formed on the inside surface of the diffuser at the end of the diffuser 11.

Moving part the separation-inducing edge 17 and relative to the surrounding, highly reactive backflow, which has been intensified by the flame-sustaining burner, the directed jet enters the combustion shaft 13 freely at an acute angle.

Figure 3:
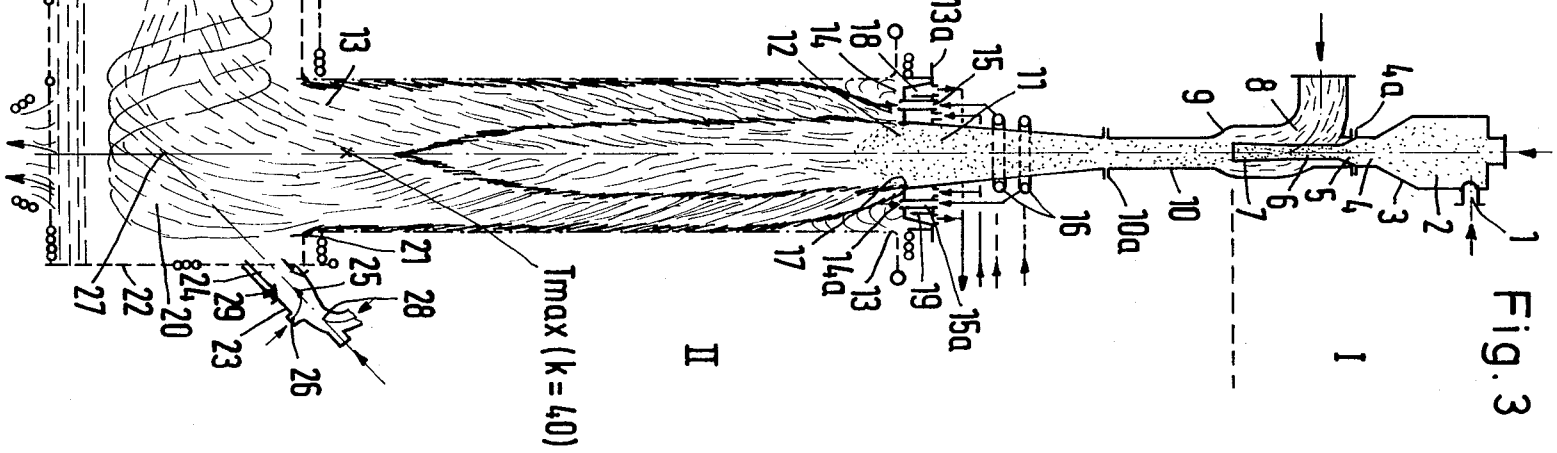
FIG. 3 is a view similar to FIG. 1 showing an ignition profile.

If the jet is discharged at a velocity of 18.5 m/sec at the outlet of the burner and the solid reactants have the trajectories obtained under the conditions described, the ignition profile shown in FIG. 3 will be obtained at the entrance of the combustion shaft 12. Owing to the sudden change in cross-section from the outlet 12 of the burner to the shaft 13 and owing to the combustion reaction, the reacting solid particles are deflected, e.g. toward the cooled wall of the shaft and in the arrangement in accordance with the invention the particles have been completely reacted and are in a molten state as they impinge on the wall of the shaft. The molten film running down on the wall of the shaft solidifies in a thickness which depends on the heat transfer to the cooling pipes contained in the shaft wall so that a protective layer is formed on the cooling shell. The molten material which contacts the solidified layer will run down on the latter toward the cyclone vessel without leaving a residue and in a desired stabilized condition.

Figure 4:
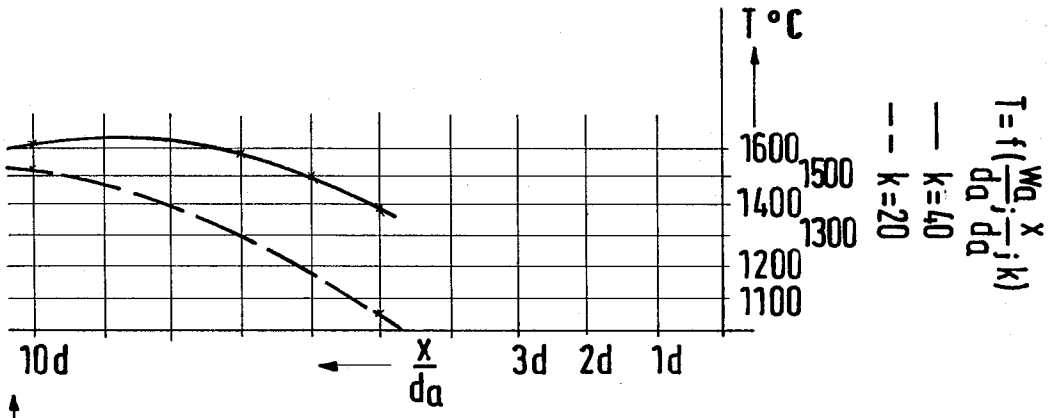
FIG. 4 is a graph of temperature plotted against distance.

A complete combustion as is indicated by the diagram of FIG. 4 is effected in the combustion shaft. In accordance with FIG. 4 the jet is heated on the short distance x to the peak temperature of 1640° C. and shortly thereafter enters the cyclone chamber 20 in a tangential direction and in said chamber is separated into gaseous and molten phases.

In the present example the process is thermally self-sufficient. In the processing of mixtures which contain less heat of reaction, additional fuel, such as pulverized coal, is supplied through the pipe 1.

The heat of reaction which is dissipated through the cooled walls of the reactor plant is used to produce 900 to 100 kg steam (at 60 bars) per 1000 kg of concentrate.

The following products are withdrawn from the cyclone vessel 20:

Copper matte having the following composition by weight:

Cu: 73.5%
Pb: 2.0%
Fe: 2.0%
S: 21.6%
Zn: 0.9%

Slag containing on a weight basis:

Co: 1.9%
Pb: 1.8%
Zn: 8.0%
Fe: 37.0%
$SiO_2$: 31.0%

Copper matte and slag jointly withdrawn in a molten state at a temperature of 1300° C. from the lower portion of the horizontal cyclone vessel.

The exhaust gas is axially discharged from the cyclone vessel at a temperature of 1320° C. and contains 56% $SO_2$ and 5% residual $O_2$.

The exhaust gas contains fine dust, which comprises oxides and sulfate and has the following composition by weight:

Cu: 6%
Pb: 16%
Zn: 24%
S: 14%
Fe: 4%

The flame-monitored pilot burner 23 mounted in the wall 22 of the cyclone vessel serves to ensure the ignition and the maintenance of the flames in the entire melting apparatus during the melting operation and to ignite and monitor the natural gas flame during the heating up phase, in which the furnace is heated up until a temperature of 1200° C. has been reached in the furnace chamber. For heating up, the gas nozzles of the flame-sustaining burner G are supplied with natural gas at a rate of up to 150 $sm^3/h$ but are not supplied with oxygen. In that case the required oxygen is supplied as air through the secondary gas passage 8, mixing passage 10 and diffuser 11 to the combustion shaft 13.

The two-chamber premix burner 23 comprises a high-pressure solid-jet nozzle, which is supplied with a reducing agent, such as oil, in order to effect a reduction of the molten material in the cyclone 20.

We claim:

1. A combustion apparatus for burning an ignitable solids/gas suspension, comprising:

a cyclone-like pressure-relief expansion vessel having a tangential inlet for a solids/primary-gas suspension and a central downwardly extending outlet;

a first vertical venturi diffusor connected to said outlet of said vessel for premixing and homogenizing said solids/primary-gas suspension and limiting vortex formation therein, said first vertical venturi diffusor having an outlet at a lower end thereof;

a secondary gas chamber surrounding said lower end, said outlet of said first vertical venturi diffusor opening vertically into said chamber, said chamber having a secondary gas inlet for supplying a secondary gas to said chamber for mixture with said solids/primary-gas suspension;

a vertical mixing duct connected to an outlet of said mixing chamber below and aligned with said first vertical venturi diffusor for mixing said secondary gas with said solids/primary-gas suspension;

a second vertical venturi diffusor connected to said vertical mixing duct for additionally mixing and homogenizing the solids/primary-gas/secondary-gas mixture formed in said duct while suppressing vortex formation therein, and for delivering the homogenized solids/primary-gas/secondary-gas mixture to a mouth at a lower end of said second vertical venturi diffusor and at which combustion is to be sustained; and a flame-sustaining annular gas burner surrounding said mouth and having fuel-gas and oxygen nozzles arranged in alternate succession around said mouth for effecting combustion of said homogenized solids/primary-gas/secondary-gas mixture in a combustion chamber into which said mouth opens.

2. The combustion apparatus defined in claim 1 wherein said vessel and said first vertical venturi diffuser are connecated by flange joints.

3. The combustion apparatus defined in claim 1 wherein said mixing duct has a diameter substantially equal to the diameter of said outlet of said first vertical venturi diffuser.

4. The combustion apparatus defined in claim 1 wherein said second vertical venturi diffuser is provided with a separation-inducing edge which projects downwardly below said flame-sustaining annular gas burner.

5. The combustion apparatus defined in claim 1 wherein said burner is mounted on the top rim of a vertical combustion shaft forming said combustion chamber and is connected to said shaft by a flange joint.

6. The combustion apparatus defined in claim 5 wherein a lower end of said combustion shaft is mounted on and communicates with a horizontal melting cyclone chamber.

7. The combustion apparatus defined in claim 6, further comprising a two-chamber premix burner mounted on said cyclone chamber adjusting said lower end of said shaft and having an axis inclined downwardly and inwardly into said cyclone chamber.

8. The combustion apparatus defined in claim 7 wherein said premix burner has an igniting passage formed with an additional high-pressure nozzle.

9. The combustion apparatus defined in claim 1, further comprising means for igniting said solids/primary-gas/secondary-gas mixture.

* * * * *